United States Patent [19]

Fender

[11] 4,074,606

[45] Feb. 21, 1978

[54] MUSICAL INSTRUMENT TRUSS ROD ASSEMBLY

[76] Inventor: C. Leo Fender, 2851 Rolling Hills Drive, SP. 33, Fullerton, Calif. 92635

[21] Appl. No.: 734,286

[22] Filed: Oct. 20, 1976

[51] Int. Cl.[2] ..... G10D 3/00
[52] U.S. Cl. ..... 84/293
[58] Field of Search ..... 84/293

[56] References Cited

U.S. PATENT DOCUMENTS

| | | | |
|---|---|---|---|
| 3,244,054 | 4/1966 | Berglund | 84/293 |
| 3,251,257 | 5/1966 | Bunker | 84/293 X |
| 3,418,876 | 12/1968 | Dopyera | 84/293 |

FOREIGN PATENT DOCUMENTS

| | | | |
|---|---|---|---|
| 978,931 | 1/1965 | United Kingdom | 84/293 |

*Primary Examiner*—Lawrence R. Franklin
*Attorney, Agent, or Firm*—Philip M. Hinderstein

[57] ABSTRACT

In a truss rod assembly for adjusting the curvature of the neck of a musical instrument of the type including an elongate, curved truss rod positionable within the instrument neck and having one end thereof fixed thereto, the other end thereof being movable to increase or decrease the tension on the truss rod to adjust the curvature of the instrument neck, there is disclosed an improvement wherein a major part of the central portion of the truss rod is flattened to increase the flexibility thereof, such flattening of the truss rod being in a plane perpendicular to the plane of curvature of the truss rod.

4 Claims, 5 Drawing Figures

MUSICAL INSTRUMENT TRUSS ROD ASSEMBLY

BACKGROUND OF THE INVENTION

1. Field of the Invention

The present invention relates to truss rod assemblies for adjusting the curvature of the neck of a musical instrument and, more particularly, to an improved truss rod assembly wherein the truss rod is flattened to increase the flexibility thereof.

2. Description of the Prior Art

In musical instruments of the type including a body and a neck, such as a guitar and an electric bass, where the instrument neck is made from wood, the neck is subject to warpage from all of the factors which usually cause such phenomenon. Since it is highly important, in such an instrument, for the fret board thereof to remain perfectly planar, it has become a common practice to provide such an instrument with means for adjusting the curvature of the neck to compensate for such warpage.

One of the more common types of such means includes a truss rod assembly positionable in the neck of the musical instrument. A common truss rod assembly is positionable within a slot in the side of the neck opposite from the fret board and includes an elongate truss rod, a fixed anchor nut at one end of the truss rod, and a fixed washer and tension nut at the other end of the truss rod. In operation, rotation of the tension nut moves the other end of the truss rod relative to the washer and tension nut, increasing or decreasing the tension on the truss rod and simultaneously adjusting the curvature of the instrument neck.

The truss rod is an elongate, cylindrical member having a linear axis before being inserted into the slot in the instrument neck, but the slot is curved so that the opposite ends of the truss rod are positioned adjacent the fret board and the center of the truss rod is positioned adjacent the opposite side of the instrument neck. The truss rod assembly is inserted into the slot in the instrument neck and the slot is filled with an elongate fill strip which is made from wood and has the configuration of the slot in the instrument neck after the truss rod assembly is inserted thereinto. The sides of the slot and the fill strip are coated with glue and the fill strip is pressed into the slot.

A number of problems have been encountered in use of truss rod assemblies of the above type. First of all, because of the curvature of the slot in the instrument neck and the thickness of the truss rod, the central portion of the fill strip is normally very thin which creates the possibility of it cracking in handling and failure in use of the instrument. More importantly, a cylindrical truss rod is not very flexible, making the above assembly procedure difficult to accomplish. Because of the inflexibility of the cylindrical truss rod, it has often been necessary to hold the fill strip with a substantial pressure during the setting of the glue holding same. Even with such pressure, the truss rod often ends up being spaced from the base of the slot in the instrument neck and simply does not operate properly once the neck has been assembled.

SUMMARY OF THE INVENTION

According to the present invention, these problems are solved in a manner unknown heretofore. With the present invention, it is possible to increase the thickness of the fill strip at the center thereof to minimize the possibility of cracking same during the handling thereof and the possibility of failure thereof during use. Furthermore, with the present truss rod assembly, the flexibility of the truss rod is substantially increased so that the truss rod more readily conforms to the curvature of the slot in the instrument neck, highly simplifying manufacturing procedures and increasing the reliability of the finished product.

Briefly, the present improvement in a truss rod assembly of the before-described type consists of flattening a major part of the central portion of the truss rod to increase the flexibility thereof in the plane of curvature thereof. Initially, the entire truss rod is cylindrical and the central portion thereof is flattened in a press.

OBJECTS

It is therefore an object of the present invention to provide a truss rod assembly for adjusting the curvature of the neck of a musical instrument.

It is a further object of the present invention to provide an improved truss rod assembly wherein the truss rod is flattened to increase the flexibility thereof.

It is a still further object of the present invention to provide a musical instrument truss rod assembly which permits an increase in the thickness of the fill strip used therewith.

It is another object of the present invention to provide a musical instrument truss rod assembly wherein the truss rod more readily conforms to the curvature of the slot therefor in the musical instrument neck.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like parts in the several figures and wherein:

DESCRIPTION OF THE PREFERRED EMBODIMENT

Figure 1:
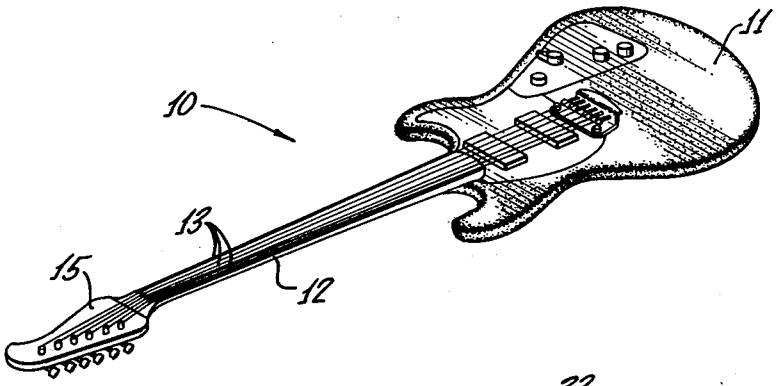
FIG. 1 is a perspective view of a conventional musical instrument of the type including a body and a neck.
Figure 2:
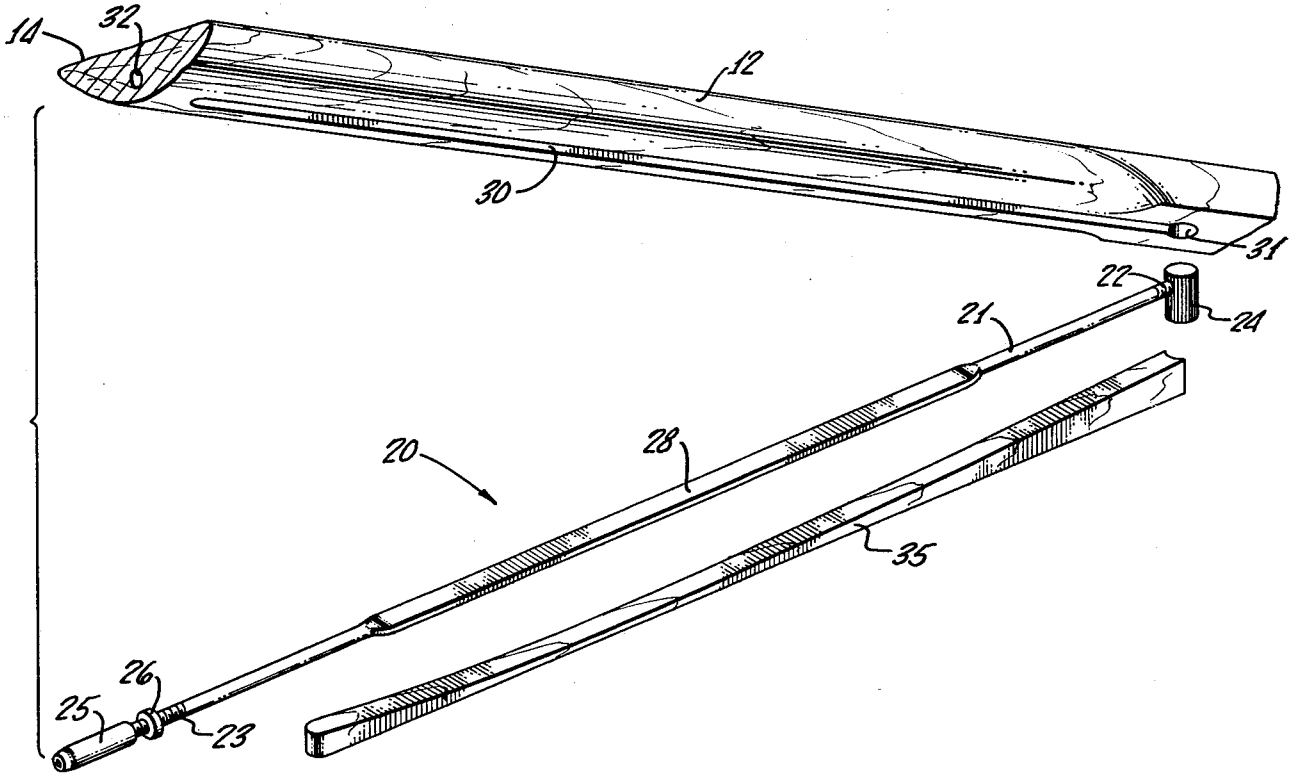
FIG. 2 is an exploded perspective view of the neck of the musical instrument of FIG. 1 showing a truss rod assembly according to the teachings of the present invention.

Referring now to the drawings, there is shown a musical instrument, generally designated 10, including a body 11, a neck 12, and a plurality of strings 13. The surface 14 of neck 12 immediately below strings 13 comprises a fret board against which strings 13 may be pressed to change the pitch thereof.

The drawings show what is generally a known type of truss rod assembly, generally designated 20, for adjusting the curvature of neck 12, particularly surface 14 thereof. The manner in which truss rod assembly differs from known truss rod assemblies will be described more fully hereinafter.

Truss rod assembly 20 is of the type including an elongate truss rod 21 which is threaded at opposite ends thereof, at 22 and 23. Threaded end 22 of truss rod 21 is engagable with an anchor nut 24 whereas threaded end 23 of truss rod 21 is engagable with a tension nut 25. Truss rod assembly 20 also includes a washer 26 positioned adjacent tension nut 25, through which truss rod 21 freely passes.

Neck 12 of instrument 10 has a slot 30 in the surface thereof opposite to surface 14 for receipt of truss rod assembly 20. As shown most clearly in FIG. 3, slot 30 is curved so that the opposite ends of truss rod 21 are positioned adjacent surface 14 and the center thereof is positioned spaced from surface 14. At one end of slot 30 is a transverse, cylindrical bore 31 in neck 12 for receipt of anchor nut 24 so that threaded end 22 of truss rod 21 is maintained stationary relative to neck 12. At the opposite end of slot 30, adjacent the head 15 of instrument 10, is a longitudinal, cylindrical bore 32 in neck 12 through which the threaded end 23 of truss rod 21 extends. Bore 32 terminates in an increased diameter, coaxial bore 33. Threaded end 23 of truss rod 21 extends through bore 32 and terminates within bore 33. Washer 26 extends over the end of truss rod 21 and contacts the shoulder formed between bores 32 and 33. Tension nut 25 then engages threaded end 23 of truss rod 21. A finishing sleeve 34 may be placed in bore 33.

Once truss rod assembly 20 is inserted into slot 30 in neck 12, as described above, the construction of neck 12 may be completed. For this purpose, neck 12 includes an elongate fill strip 35 having the same basic configuration as slot 30, less the space required for truss rod 21. Therefore, once truss rod assembly 20 is inserted into slot 30 in neck 12, the sides of slot 30 and fill strip 35 are coated with glue and fill strip 35 is pressed into slot 30. Neck 12 is then set aside until the glue sets.

Figure 3:
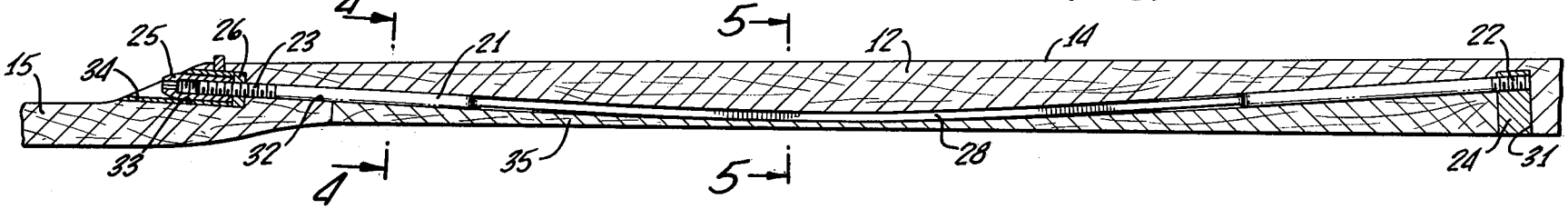
FIG. 3 is a longitudinal sectional view of the neck of FIG. 2 taken through the plane of curvature of the truss rod.
Figure 4:
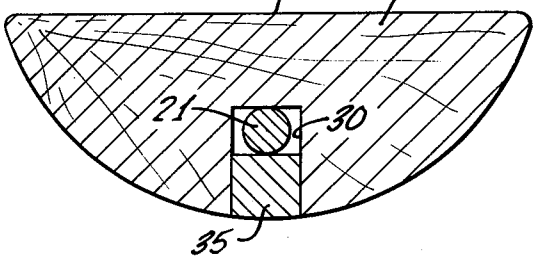
FIGS. 4 and 5 are sectional views taken along the lines 4—4 and 5—5, respectively, in FIG. 3.

It will be obvious from an inspection of FIG. 3 that rotation of tension nut 25 causes axial movement of threaded end 23 of truss rod 21 relative to washer 26 and neck 12. Depending upon the direction of rotation of nut 25, this increases or decreases the tension on truss rod 21 so as to adjust the curvature of neck 12 and, more particularly, surface 14 thereof. This operation of truss rod assembly 20 is well known to those skilled in the art.

According to the present invention, the before-mentioned problems associated with truss rod assemblies of this type are solved by flattening a major portion 28 of the central part of truss rod 21 in a plane perpendicular to the plane of curvature thereof. This flattened portion 28 of truss rod 21 extends between threaded ends 22 and 23. According to the preferred embodiment of the present invention, truss rod 21 is initially entirely cylindrical in shape and flattened portion 28 is accomplished by subjecting such portion to the high impact forces of a press.

Figure 5:
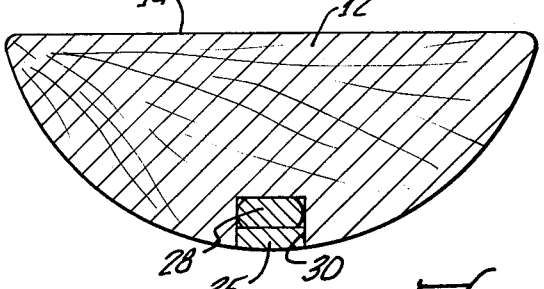

With such construction, a number of advantages are achieved. First of all, without changing the dimensions of slot 30 in neck 12 of instrument 10, it is possible to increase the thickness of fill strip 35, at the center thereof, to minimize the possibility of cracking same during the handling thereof and the possibility of failure of same during use. As can be seen from FIGS. 3 and 5, the central portion of fill strip 35 is quite thin even with the improved truss rod assembly and is significantly thinner without such improvement.

Furthermore, with central portion 28 of truss rod 21 flattened, the flexibility of truss rod 21 is substantially increased so that truss rod 21 more readily conforms to the curvature of slot 30 in neck 12 of instrument 10. It is no longer necessary to hold fill strip 35 with a substantial pressure during the setting of the glue holding same. In addition, it is a simple matter to insure good contact between central portion 28 of truss rod 21 with the base of slot 30 to insure the proper operation of truss rod assembly 20 in use.

While the invention has been described with respect to the preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

I claim:

1. In a musical instrument of the type including a neck having a slot in one side thereof for receipt of a truss rod assembly, said truss rod assembly including an elongate, curved truss rod, a fixed anchor nut at one end of said truss rod, and a washer and tension nut at the other end of said truss rod, rotation of said tension nut increasing or decreasing the tension on said truss rod to adjust the curvature of said instrument neck, the improvement wherein a major portion of said truss rod, between said anchor nut and said washer, is flat in a plane perpendicular to the plane of curvature of said truss rod to increase the flexibility of said truss rod.

2. In a musical instrument according to claim 1, the improvement wherein said truss rod is initially entirely circular in cross-section and wherein said flat portion is subsequently flattened in a press.

3. In a truss rod assembly for adjusting the curvature of the neck of a musical instrument of the type including an elongate truss rod positionable within said instrument neck and having one end thereof fixed thereto, the other end thereof being movable to increase or decrease the tension on said truss rod to adjust the curvature of said instrument neck, the improvement wherein the central portion of said truss rod is flattened to increase the flexibility thereof.

4. In a truss rod assembly according to claim 3, the improvement wherein said truss rod is flattened in a plane perpendicular to the plane of curvature thereof.

* * * * *